US008390524B2

(12) United States Patent
Someya

(10) Patent No.: US 8,390,524 B2
(45) Date of Patent: Mar. 5, 2013

(54) ANTENNA DEVICE, RECEPTION DEVICE AND RADIO WAVE TIMEPIECE

(75) Inventor: Kaoru Someya, Kiyose (JP)

(73) Assignee: Casio Computer Co., Ltd., Tokyo (JP)

( * ) Notice: Subject to any disclaimer, the term of this patent is extended or adjusted under 35 U.S.C. 154(b) by 685 days.

(21) Appl. No.: 12/611,267

(22) Filed: Nov. 3, 2009

(65) Prior Publication Data

US 2010/0144300 A1 Jun. 10, 2010

(30) Foreign Application Priority Data

Dec. 10, 2008 (JP) ..... 2008-314413

(51) Int. Cl.
*H01Q 1/12* (2006.01)

(52) U.S. Cl. ..... 343/718; 343/787; 368/47

(58) Field of Classification Search ..... 343/702, 343/718, 787; 368/10, 47
See application file for complete search history.

(56) References Cited

U.S. PATENT DOCUMENTS

| | | | | |
|---|---|---|---|---|
| 4,754,285 | A * | 6/1988 | Robitaille | 343/718 |
| 5,696,518 | A * | 12/1997 | Itoh et al. | 343/718 |
| 5,798,984 | A * | 8/1998 | Koch | 368/10 |
| 6,134,188 | A * | 10/2000 | Ganter et al. | 368/47 |
| 6,373,439 | B1 * | 4/2002 | Zurcher et al. | 343/718 |
| 6,417,807 | B1 | 7/2002 | Hsu et al. | |
| 7,463,208 | B2 * | 12/2008 | Araki et al. | 343/787 |
| 7,522,117 | B2 * | 4/2009 | Takahashi | 343/787 |
| 2004/0214605 | A1 | 10/2004 | Zhang et al. | |
| 2005/0057399 | A1 | 3/2005 | Kipnis et al. | |
| 2007/0097796 | A1 | 5/2007 | Someya et al. | |
| 2007/0200648 | A1 | 8/2007 | Reichenbach et al. | |

FOREIGN PATENT DOCUMENTS

| | | | |
|---|---|---|---|
| JP | 2000-188558 | A | 7/2000 |
| JP | 2005-201775 | A | 7/2005 |
| JP | 2007-124335 | A | 5/2007 |
| WO | WO 2006/055961 | A2 | 5/2006 |

OTHER PUBLICATIONS

Extended European Search Report dated Dec. 20, 2010 (in English) in counterpart European Application No. 09178132.8.
Partial European Search Report dated Sep. 30, 2010 (in English) in counterpart European Application No. 09178132.8.

* cited by examiner

*Primary Examiner* — Tho G Phan
(74) *Attorney, Agent, or Firm* — Holtz, Holtz, Goodman & Chick, PC

(57) ABSTRACT

An antenna device including: an antenna unit having an oscillating body capable of oscillating at a predetermined natural frequency and being displaceable by an external magnetic field, and a converter for converting motion of the oscillating body to an electrical signal, when a radio wave signal having a frequency band for inducing resonance of the oscillating body comes, the oscillating body resonating with a magnetic field component of the radio wave signal, the converter converting resonance of the oscillating body to the electrical signal, and an electrical signal corresponding to the radio wave signal being outputted; a sensitivity varying section capable of varying degree of displacement of the oscillating body occurring by the external magnetic field; and a sensitivity controller for adjusting the degree of the displacement by using the sensitivity varying section in accordance with the electrical signal outputted from the antenna unit.

18 Claims, 7 Drawing Sheets

ANTENNA DEVICE, RECEPTION DEVICE AND RADIO WAVE TIMEPIECE

CROSS-REFERENCE TO RELATED APPLICATIONS

This application is based on and claims the benefit of priority from the prior Japanese Patent Application No. 2008-314413 filed on Dec. 10, 2008 including specification, claims, drawings and summary, the entire contents of which are incorporated herein by reference.

BACKGROUND OF THE INVENTION

1. Field of the Invention

The present invention relates to an antenna device and a reception device for receiving a radio wave signal, and a radio wave timepiece for receiving a standard radio wave containing a time code.

2. Description of Related Art

In general, various antennas such as a linear antenna, a winding wire type bar antenna, a planar antenna, etc. are known. The winding wire type bar antenna is used for a radio wave timepiece or the like for receiving a standard radio wave because it is necessary to mount an antenna in a small timepiece body.

General antennas such as the linear antenna, the winding wire type bar antenna, etc. are restricted in miniaturization. That is because the linear antenna is required to have the length corresponding to a reception frequency band, and the winding wire type bar antenna is deteriorated in effective Q-value (sharpness of resonance peak) and sensitivity due to an effect of demagnetizing field when the core thereof is short.

Furthermore, because the winding wire type bar antenna, when metal elements are proximate to it, induces eddy current there due to variation of magnetic flux occurring in a winding coil and a core, and occurrence of eddy current remarkably reduces the sensitivity of the antenna.

SUMMARY OF THE INVENTION

According to a first aspect of the present invention, an antenna device comprises: an antenna unit having an oscillating body capable of oscillating at a predetermined natural frequency and being displaceable by an external magnetic field, and a converter for converting motion of the oscillating body to an electrical signal, when a radio wave signal having a frequency band for inducing resonance of the oscillating body comes, the oscillating body resonating with a magnetic field component of the radio wave signal, the converter converting resonance of the oscillating body to the electrical signal, and an electrical signal corresponding to the radio wave signal being outputted; a sensitivity varying section capable of varying degree of displacement of the oscillating body occurring by the external magnetic field; and a sensitivity controller for adjusting the degree of the displacement by using the sensitivity varying section in accordance with the electrical signal outputted from the antenna unit.

According to a second aspect of the present invention, an antenna device comprises: a plurality of antenna units each of which has an oscillating body capable of oscillating at a predetermined natural frequency and being displaceable by an external magnetic field, and a converter for converting motion of the oscillating body to an electrical signal, when a radio wave signal having a frequency band for inducing resonance of the oscillating body comes, the oscillating body resonating with a magnetic field component of the radio wave signal, the converter converting resonance of the oscillating body to the electrical signal, and an electrical signal corresponding to the radio wave signal being outputted, and each of the antenna units being configured so that degree of displacement of the oscillating body by the external magnetic field is different with respect to each of the antenna units; and a mixer for mixing outputs of the plurality of antenna units and outputting a mixed signal.

According to a third aspect of the present invention, an antenna device comprises: a plurality of antenna units each of which has an oscillating body capable of oscillating at a predetermined natural frequency and being displaceable by an external magnetic field, and a converter for converting motion of the oscillating body to an electrical signal, when a radio wave signal having a frequency band for inducing resonance of the oscillating body comes, the oscillating body resonating with a magnetic field component of the radio wave signal, the converter converting resonance of the oscillating body to the electrical signal, and an electrical signal corresponding to the radio wave signal being outputted, and each of the antenna units being configured so that degree of displacement of the oscillating body by the external magnetic field is different with respect to each of the antenna units; and a switch section for selectively sending an electrical signal from one of the plurality of antenna units to a subsequent stage.

BRIEF DESCRIPTION OF THE DRAWINGS

FIGS. 9A and 9B show the MEMS antenna of FIG. 8, wherein FIG. 9A is a longitudinally sectional view and FIG. 9B is a plan view of a substrate surface.

FIGS. 11A and 11B show the MEMS antenna of FIG. 10, wherein FIG. 11A is a longitudinally sectional view and FIG. 11B is a plan view showing the substrate surface including a sensitivity adjusting coil.

DESCRIPTION OF THE PREFERRED EMBODIMENT

Embodiments of the present invention will be described with reference to the accompanying drawings.

First Embodiment

Figure 1:
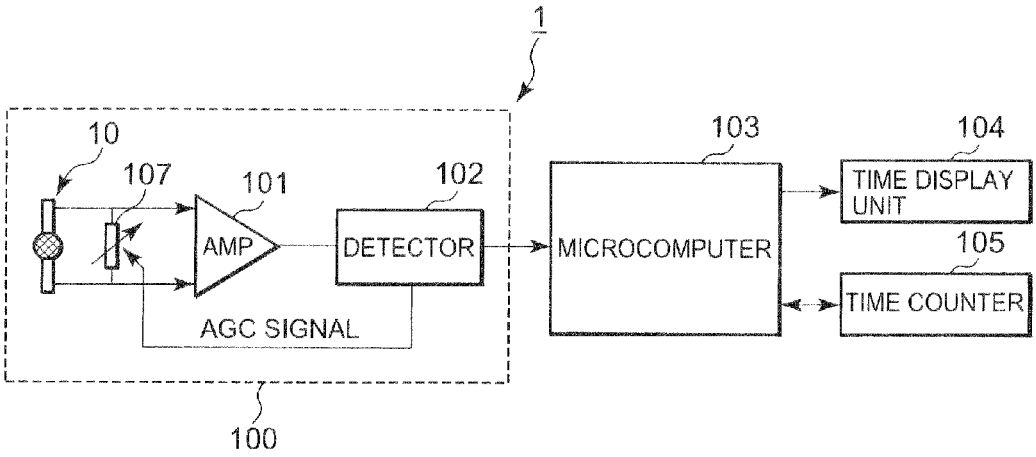
FIG. 1 is a diagram showing the overall construction of a radio wave timepiece according to a first embodiment of the present invention.

FIG. 1 is a diagram showing the overall construction of a radio wave timepiece according to a first embodiment of the present invention.

The radio wave timepiece 1 of this embodiment has an MEMS antenna 10 as an antenna unit for receiving a standard radio wave modulated by a time code, a variable resistor 107 serving as a sensitivity varying section and a variable impedance section for varying the sensitivity of the MEMS antenna 10, a fixed resistor 110 (see FIG. 4), an amplifier 101 for amplifying a reception signal outputted from the MEMS antenna 10, a detector 102 as a demodulator for detecting a reception signal and extracting a time code, a microcomputer 103 for executing the overall control of the timepiece 1, a time display unit 104 for displaying the time, a time counter 105 for counting the time, etc. In this embodiment, a radio wave receiver 100 as a reception device is constructed by the MEMS antenna 10, the variable resistor 107, the amplifier 101 and the detector 102.

The variable resistor 107 passes current generated by the receiving movement of the MEMS antenna 10 between the output terminals of the MEMS antenna 10 and reduces the voltage variation amount between wires h1 and h2. Consequently, the variable resistor 107 functions to suppress the receiving movement of the MEMS antenna 10 and further to reduce the Q-value of the MEMS antenna 10 so that the sensitivity of the MEMS antenna 10 is lowered. The reduction amount of the sensitivity of the MEMS antenna 10 is varied by changing the resistance value of the variable resistor 107.

The detector 102 functions to detect an amplitude-modulated reception signal into a time code, and also functions as a sensitivity controller. For example, the detector 102 generates a signal representing the maximum amplitude of the reception signal therein, and also generates an AGC (automatic gain control) signal for varying the resistance value of the variable resistor 107 so that the maximum amplitude does not run over a fixed range. For further example, the detector 102 generates such an AGC signal as to reduce the resistance value of the variable resistor 107 when the maximum amplitude of the reception signal increases and also to increase the resistance value of the variable resistor 107 when the maximum amplitude of the reception signal decreases.

A circuit for generating the AGC signal is not required to be provided in the detector 102. For example, a dedicated AGC circuit may be provided, and the AGC circuit may take the output of the amplifier 101 or the MEMS antenna 10 to generate the AGC signal as described above. The microcomputer 103 may be designed so as to generate the AGC signal as described above through digital processing based on the detection output from the detector 102.

The radio wave receiver 100 is formed on a single semiconductor substrate together with the MEMS antenna 10. Furthermore, not only the radio wave receiver 100, but also the microcomputer 103 and the time counter 105 may be formed on the single semiconductor substrate.

Figure 2:
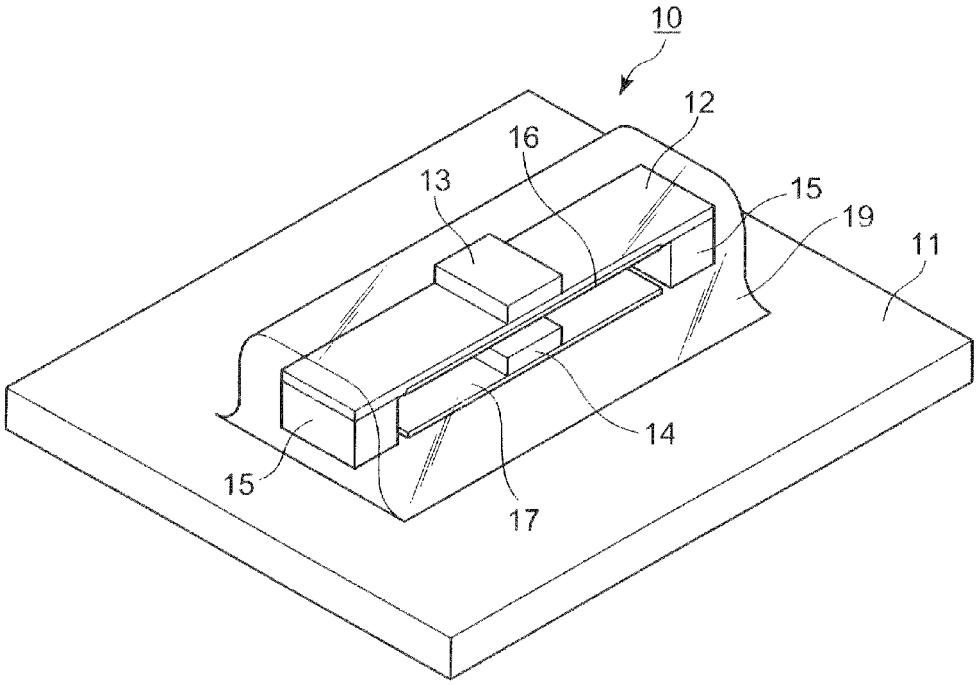
FIG. 2 is a perspective view showing the construction of an MEMS antenna 10 of FIG. 1.
Figure 3:
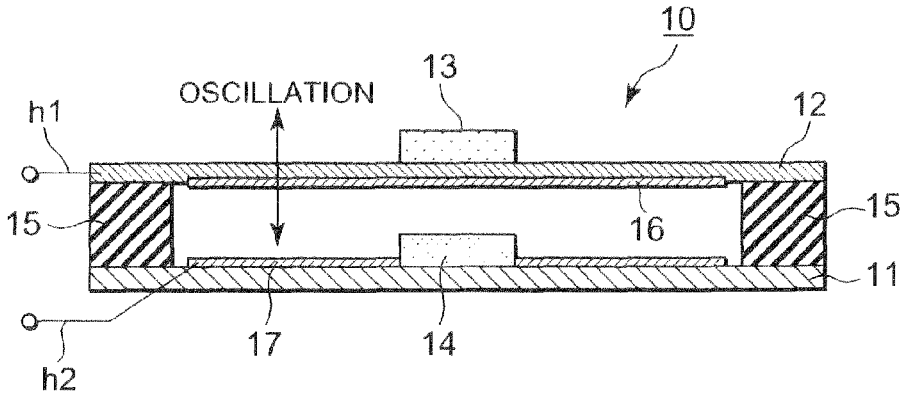
FIG. 3 is a longitudinally-sectional view of the MEMS antenna 10 of FIG. 1.

FIG. 2 is a perspective view showing the construction of the MEMS antenna 10 of the first embodiment, and FIG. 3 is a longitudinally sectional view of the MEMS antenna 10.

The MEMS antenna 10 is an extremely small (for example, several millimeters or less, or micrometer-order size) antenna formed on a semiconductor substrate by using MEMS (Micro Electro Mechanical Systems) fabrication technique, and receives a magnetic field component of a radio wave signal to convert the received radio wave to the corresponding electrical signal.

As shown in FIGS. 2 and 3, the MEMS antenna 10 comprises a beam 12 formed on a substrate 11, spacers 15 composed of insulating material and fixing a part of the beam 12, a magnetic member 13 formed on a movable range of the beam 12, a permanent magnet 14 fixed at the lower side of the beam 12, a planar electrode (first electrode) 16 formed on the beam 12, a planar electrode 17 (second electrode) formed at a site on the substrate 11 so as to face the beam 12, etc. A space is provided around the beam 12 and the surrounding of the beam 12 is sealed by resin 19 or the like so that the beam 12 is displaceable in the vertical direction. The beam 12 itself may have electrical conductivity so that the beam 12 is also used as the electrode 16.

In this embodiment, the beam 12 and the magnetic member 13 constitute an oscillating body, and the electrodes 16 and 17 constitute a converter for converting the displacement of the beam 12 to the electrical signal.

The beam 12 is formed of silicon, for example. The beam 12 is configured to be board-like so that the longitudinal direction thereof is along the substrate 11, a part of the beam 12 (for example, both the end portions) is fixed to the substrate 11 through the spacers 15 and the other site are floated through a space above the substrate 11. The space at the lower side of the beam 12 may be formed by etching a sacrifice layer or the like. The unfixed site of the beam 12 can oscillate in the vertical direction with respect to the substrate 11.

The natural frequency of the beam 12 can be set to a desired frequency by adjusting the length, thickness or the like of the beam 12, and in this embodiment it is set to be equal to the frequency (for example, 60 kHz) of the carrier of the standard radio wave. Furthermore, by properly combining the beam 12 with SiGe (silicon germanium) or other material, the temperature compensation of the oscillation characteristic as described above can be performed.

The planar electrode 16 formed on the beam 12 and the planar electrode 17 formed on the substrate 11 are disposed so as to face each other, and constitute electric capacity. For example, they are formed by vapor deposition of metal material. Aluminum or the like which is not magnetized is preferably used as the metal material. In place of the formation of the electrode 16 on the beam 12, the material constituting the beam 12 may be doped to have electrical conductivity, whereby the beam 12 itself functions as an electrode.

Wires h1 and h2 are connected to the electrodes 16 and 17 by a normal semiconductor fabrication process, and these wires h1 and h2 are led out onto the substrate 11. In FIG. 3, the wires h1 and h2 are illustrated as being simplified. However, actually, the wire h2 at the substrate 11 side is directly led out to the outside of the MEMS antenna 10 on the substrate 11, and the wire h1 at the beam 12 side is led through a contact hole formed in the spacer 15 to the substrate 11, and then led out to the outside of the MEMS antenna 10 on the substrate 11.

The spacers 15 are formed of silicon oxide film ($SiO_2$) or the like so as to have an insulating property.

The permanent magnet 14 applies magnetic force to the magnetic member 13 of the beam 12. For example, ferromagnetic material block is formed through thin-film deposition of ferromagnetic material by sputtering, and then strong magnetic field is applied to the ferromagnetic material block to magnetize the ferromagnetic material in a specific direction, whereby permanent magnet 14 can be formed.

The magnetic member 13 on the beam 12 receives a magnetic field component of a radio wave signal to be magnetized, so that repulsive force or attractive force to be applied to the permanent magnet 14 is generated, thereby displacing the beam 12. For example, the magnetic member 13 can be formed by thin-film deposition of magnetic material (for example, soft magnetic material) using sputtering.

Figure 4:
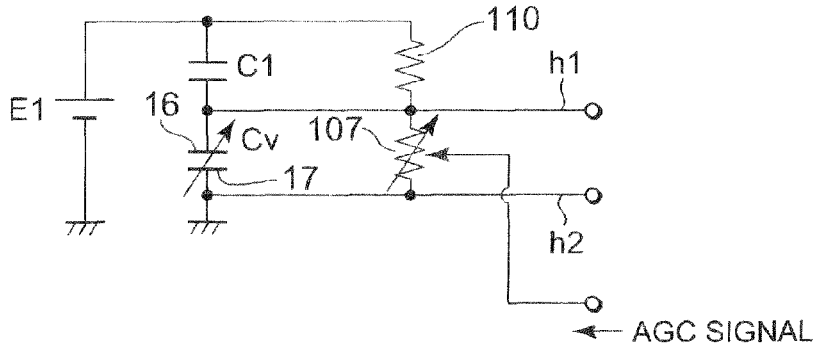
FIG. 4 is a circuit diagram showing the electrical configuration of the MEMS antenna of FIG. 1.

FIG. 4 is a circuit diagram showing the electrical configuration of the MEMS antenna 10.

As shown in FIG. 4, the electrodes 16 and 17 of the MEMS antenna 10 constitute a variable capacitor Cv which varies the magnitude of the electrical capacitance due to the displacement of the beam 12. A capacitance element. C1 is connected to the variable capacitor Cv in series on the semiconductor substrate, and a voltage E1 is applied to the series circuit of these elements. According to this construction, when the beam 12 is displaced, the capacitance value of the variable capacitor Cv is varied, so that the electrical signal (voltage) corresponding to the displacement of the beam 12 is outputted between the terminals of the variable capacitor Cv. The same action can be attained by connecting a resistance element to the variable capacitance Cv in series in place of the capacitance element C1 of FIG. 4.

Here, the action of the variable resistor 107 will be described. When the resistance of the variable resistor 107 is set to a high value, current hardly flows through the variable resistor 107, and thus it hardly brings energetic loss to the displacement of the beam 12 and the capacitance variation of the variable capacitor Cv. The same is applied to the properly selected fixed resistor 110. Since the input impedance of the amplifier 101 is also very high, current hardly flows from the MEMS antenna 10 into the amplifier 101, and thus it hardly brings energetic loss to the displacement of the beam 12 and the capacitance variation of the variable capacitor Cv.

On the other hand, when the resistance value of the variable resistor 107 is set to a low value, and the capacitance value of the variable capacitor Cv is varied due to the displacement of the beam 12, current flows into the variable resistor 107 and thus power consumption occurs. This power consumption acts to suppress the displacement of the beam 12. Accordingly, by setting the resistance value of the variable resistor 107 to a low value, the displacement degree of the beam 12 with respect to the external magnetic field is lowered, and the reception sensitivity of the MEMS antenna 10 can be lowered.

Next, the operation of the radio wave timepiece 1 and the radio wave receiver 100 will be described.

The microcomputer 103 updates the output data to the time display unit 104 in synchronism with the time-count data of the time counter 105 to display the time. Furthermore, when a predetermined time comes, the microcomputer 103 executes a radio wave reception control program to actuate the radio wave receiver 100, whereby the standard radio wave transmitted through the carrier wave of a predetermined frequency band is received by the radio wave receiver 100 and a time code is extracted from this reception signal.

Figure 5:
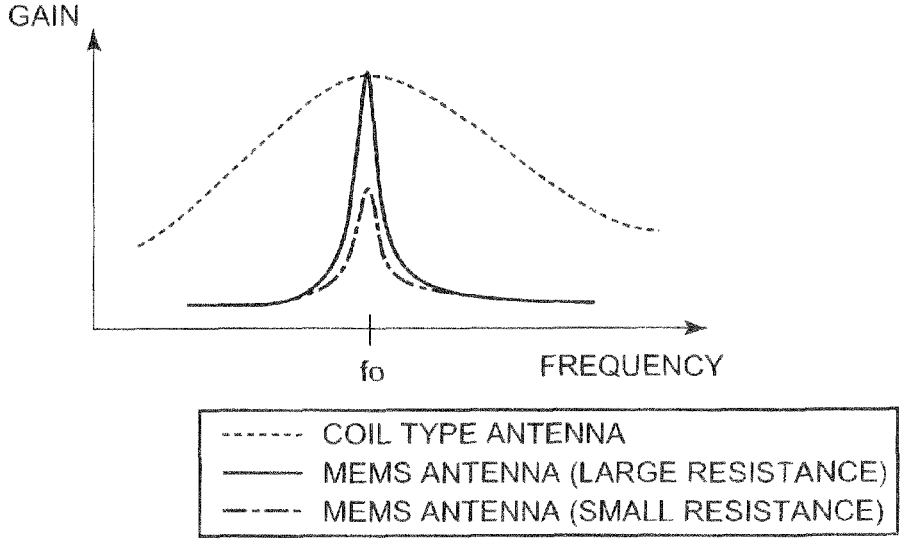
FIG. 5 is a graph showing the frequency characteristics of the MEMS antenna and a conventional coil type antenna.

FIG. 5 is a graph showing the frequency characteristic of the MEMS antenna and the conventional coil type antenna.

The beam 12 formed by the MEMS fabrication technique has such a frequency characteristic that it greatly resonates in only a natural frequency range having a narrow band. Therefore, in the MEMS antenna 10 of this embodiment, when the standard radio wave having the frequency band (for example, 60 kHz) corresponding to the natural frequency of the beam 12 comes, the magnetic field component of this radio wave signal applies acting force to the beam 12, so that the beam resonates. In addition, the beam 12 is displaced in accordance with the magnitude of the magnetic field component of the radio wave signal.

The displacement of the beam 12 is transformed to the capacitance variation of the variable capacitor Cv, and the electrical signal corresponding to the capacitance variation is outputted from the MEMS antenna 10 to the amplifier 101. This electrical signal is a signal obtained by substantially directly converting the incoming standard radio wave to the electrical signal. This electrical signal is amplified by the amplifier 101, and then sent to the detector 102 to extract the time code.

On the other hand, when a radio wave whose frequency band is out of the natural frequency of the beam 12 comes, the magnetic field component of this radio wave signal applies acting force to the beam 12. However, this acting force changes at a frequency other than the natural frequency of the beam 12, and thus this acting force is absorbed and extinguished in the beam 12, so that the beam 12 does not oscillate. Accordingly, the capacitance variation of the variable capacitor Cv does not occur, and the output signal of the MEMS antenna 10 is substantially equal to zero.

Furthermore, when a mixture of the standard radio wave and a radio wave having a frequency band other than the natural frequency of the standard radio wave come, both the radio waves act on the beam 12 so that the actions of both the radio waves on the beam are overlapped with each other. Therefore, the radio wave having the frequency band deviated from the natural frequency of the beam 12 is removed, and only the standard radio wave is extracted and received by the MEMS antenna 10. Accordingly, only the signal of the standard radio wave is sent to the amplifier 101 and the detector 102.

As indicated by a solid line of FIG. 5, according to the MEMS antenna 10, there can be obtained a characteristic that only a radio wave having a specific frequency f0 is received with a very high Q value and radio waves having frequencies out of the specific frequency f0 can be greatly removed. For comparison, the frequency characteristic of a coil type antenna indicated by a broken line in FIG. 5. As is apparent from the comparison between the characteristic lines indicated by the solid line and the broken line in FIG. 5, with respect to the MEMS antenna 10, the Q-value of the reception gain of the antenna itself is much higher as compared with the coil type antenna.

Next, a case where the signal level of the standard radio wave is very large will be described.

When the signal level of the standard radio wave is excessively increased, the oscillation amplitude of the beam 12 reaches maximum amplitude and thus it is saturated. At this time, the oscillation amplitude of the beam 12 hardly varies during both a high level period and a low-level period of the time code amplitude-modulating the standard radio wave. In such a case, the signal waveform of the detected time code is distorted without any action.

Therefore, in the radio wave receiver 100 of this embodiment, when the amplitude maximum value of the output signal of the MEMS antenna 10 exceeds a fixed range, this fact is detected, and such an AGC signal as to reduce the resistance value of the variable resistor 107 is outputted from the detector 102.

When the resistance value of the variable resistor 107 is lowered, the oscillation of the beam 12 of the MEMS antenna 10 is suppressed by the power consumption in the variable resistor 107 as described above. By the suppressing action of the oscillation, the oscillation amplitude of the beam 12 is converged into a proper range because of the reduction of the Q-value based on the variable resistor 107 even when a standard radio wave having an excessively large signal level is received. That is, as indicated by a characteristic line of a one-dotted chain line of FIG. 5, the reception sensitivity of the MEMS antenna 10 is lowered. Therefore, when the standard radio wave having an excessively large signal level is received, a reception signal having a proper signal level can be outputted. Then, the reception signal having the proper signal level is sent to the detector 102, and the time code is extracted from the reception signal.

When the detected time code is sent to the microcomputer 103, the microcomputer 103 determines the accurate present time from the time code. When any time lag exists in the counted time of the time counter 105, the microcomputer 103 corrects this time lag automatically. Through the control operation as described above, the accurate time display can be performed at all times.

As described above, according to the MEMS antenna 10 and the radio wave receiver 100 of this embodiment, the reception sensitivity of the MEMS antenna 10 can be varied by the variable resistor 107. Accordingly, even when the signal level of the received standard radio wave is excessively large, the radio wave can be received normally by lowering the reception sensitivity.

Furthermore, when the amplitude of the reception signal is excessively large, the resistance value of the variable resistor 107 is controlled to be automatically lowered by the AGC signal outputted from the detector 102. Therefore, following the variation of the signal level of the standard radio wave, the sensitivity of the MEMS antenna 10 is automatically adjusted, and the radio wave can be received normally at all times.

Furthermore, the variable resistor 107 connected between the output terminals of the MEMS antenna 10 is adopted as the sensitivity varying section for suppressing the oscillation of the beam 12 of the MEMS antenna 10. Therefore, the sensitivity varying section can be easily formed by the semiconductor fabrication process, and the occupation area of the sensitivity varying section on the chip can be reduced.

According to the radio wave timepiece 1 of this embodiment, the radio wave receiver 100 can be extremely miniaturized together with the MEMS antenna 10. Furthermore, the MEMS antenna 10 itself has a filter characteristic of a narrow band, and thus it is unnecessary to provide a narrow-band filter or the like separately, so that the circuit of the radio wave receiver 100 can be simplified and the mount area can be reduced. Therefore, an antenna and a reception circuit can be mounted in a small apparatus such as a wrist watch body or the like with extra space.

Furthermore, in the coil type antenna, relatively large variation of magnetic flux occurs in the coil or the core through the reception of radio waves. Therefore, eddy current occurs in neighboring metal, and occurrence of eddy current causes a problem that the reception sensitivity is greatly lowered. The MEMS antenna 10 prevents occurrence of such eddy current, and thus the reception sensitivity is not lowered. Accordingly, the degree of freedom of locations of the antenna and the reception circuit can be increased even when they are mounted at the interior of the radio wave timepiece which is surrounded by a metal housing.

[Modification of MEMS Antenna]

Figure 6:
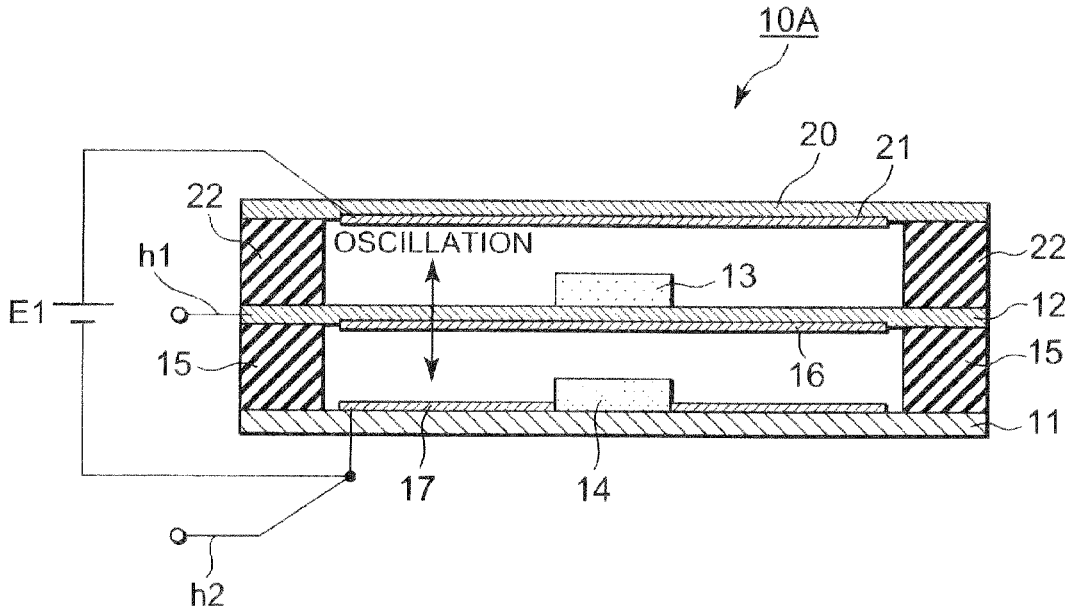
FIG. 6 is a longitudinally sectional view showing a first modification of the MEMS antenna.

FIG. 6 is a longitudinally sectional view of a first modification of the MEMS antenna.

The MEMS antenna 10A of this modification can take out a relatively large electrical signal by an electrode also provided at the upper side of the beam 12 (the opposite side to the substrate 11). The basic construction is the same as the MEMS antenna 10 of FIG. 2. The same constituent elements are represented by the same reference numerals, and the description thereof is omitted.

In the MEMS antenna 10A of this modification, a board-like cover plate 20 is provided so as to cover the upper side of the beam 12, and a planar electrode (third electrode) 21 is formed on the cover plate 20. The cover plate 20 is formed so as to be floated from the beam 12 through the spacers 22 so that the free displacement of the beam 12 is not disturbed.

The cover plate 20 as described above can be formed of the same material in the same fabrication process as the beam 12. Furthermore, the cover plate 20 is formed with increasing the thickness or hardness thereof so that it is not oscillated like the beam 12.

The electrode 21 can be formed of the same material in the same fabrication process as the electrode 16 of the beam 12, and also the spacers 22 can be formed of the same material in the same fabrication process as the spacers 15 for supporting the beam 12. The spacers 22 are arranged so as to be overlapped with the spacers 15 for supporting the beam 12.

Figure 7:
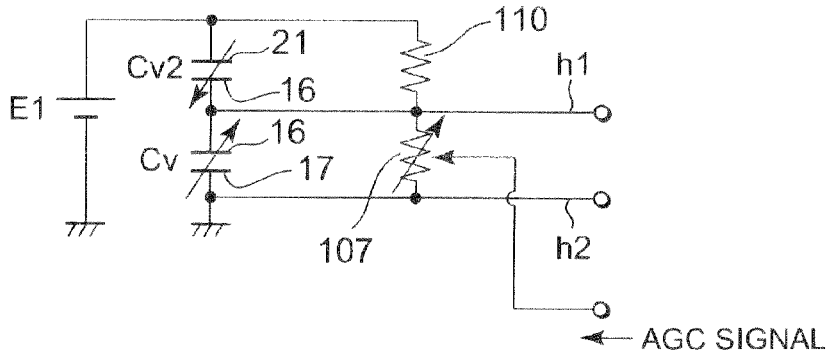
FIG. 7 is a circuit diagram showing the electrical connection construction of the MEMS antenna of the first modification.

FIG. 7 is a circuit diagram showing the electrical connection construction of the MEMS antenna of the first modification.

As shown in FIG. 7, the three electrodes 17, 16 and 21 constitute two variable capacitors Cv and Cv2 which are variable in electrical capacitance through the displacement of the beam 12. Specifically, the electrode 16 of the beam 12 and the electrode 17 at the substrate 11 constitute one variable capacitor Cv, and the electrode 16 of the beam 12 and the electrode 21 of the cover plate 20 constitute the her variable capacitor Cv2. The two variable capacitors Cv and Cv2 are connected to each other in series, and a fixed voltage E1 is applied to this series circuit. The variable resistor 107 is connected between the terminals of the variable capacitor Cv outputting the reception signal.

According to the above construction, when the beam 12 is displaced, the capacitance values of the two variable capacitors Cv and Cv2 vary in the opposite directions (positive and negative directions), whereby the electrical signal corresponding to the displacement of the beam 12 is outputted between the terminals of the variable capacitor Cv. According to this construction, as compared with the above circuit shown in FIG. 4, the amplitude of the output voltage can be substantially doubled.

Furthermore, even in the thus-constructed MEMS antenna 10A, the suppression amount of the oscillation of the beam 12 is varied by changing the resistance value of the variable resistor 107, whereby a normal reception signal can be outputted from the MEMS antenna 10A even when a standard radio wave having an excessively large signal level comes.

Second Embodiment

Figure 8:
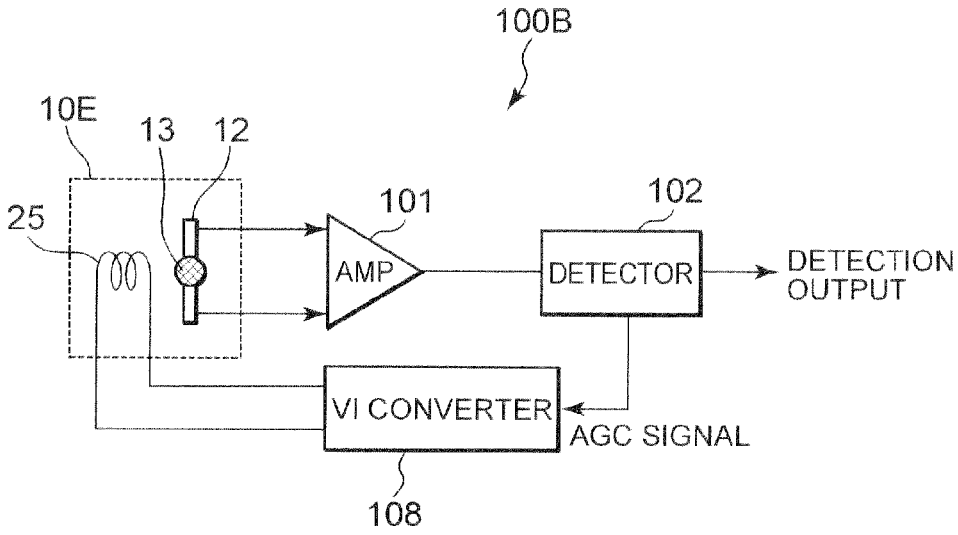
FIG. 8 is a diagram showing the construction of a radio wave receiver of a second embodiment according to the present invention.

FIG. 8 is a diagram showing the construction of a radio wave receiver 100B of a second embodiment.

The radio wave receiver 100B of the second embodiment is different from the first embodiment only with respect to the MEMS antenna 10E and the construction for varying the reception sensitivity thereof. The same constituent elements as the first embodiment are represented by the same reference numerals, and the description thereof is omitted.

The radio wave receiver 100B of this embodiment has an MEMS antenna 10E having a coil magnet 25, a VI converter 108 as a variable current source for outputting current to the coil magnet 25 and also varying the amount of current in accordance with an AGC signal, an amplifier 101 for amplifying a reception signal, and a detector 102 for detecting the reception signal into a time code and outputting an AGC signal for adjusting the reception sensitivity.

Figure 9A:
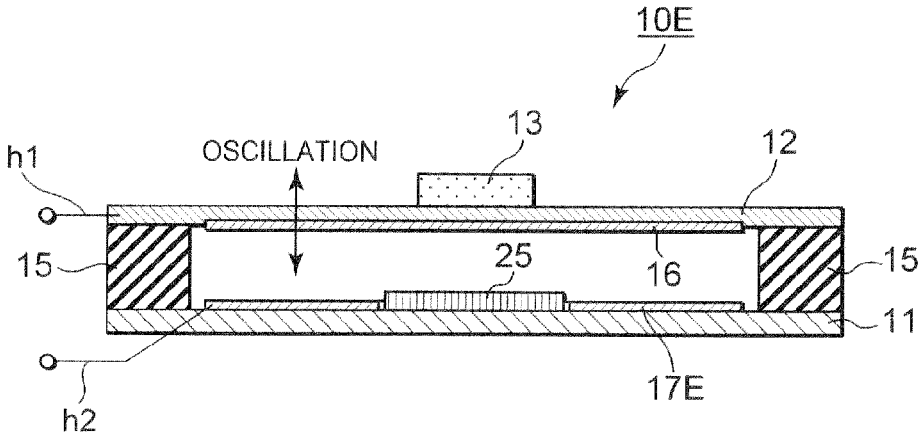
Figure 9B:
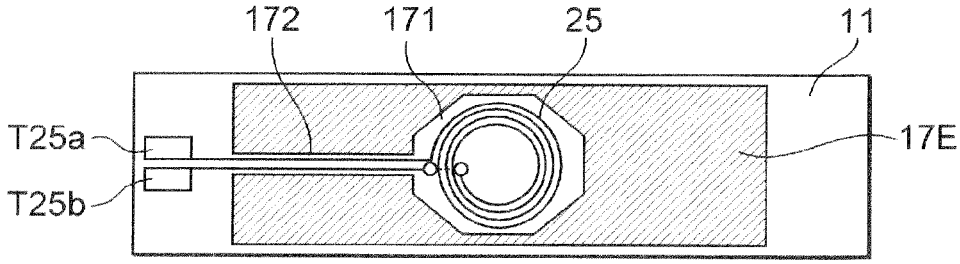

FIGS. 9A and 9B show the MEMS antenna 10E of second embodiment, wherein FIG. 9A is a longitudinally sectional view, and FIG. 9B is a plan view of the substrate surface.

In the MEMS antenna 10E of the second embodiment, a coil magnetic (electromagnet) 25 is applied in place of the permanent magnet as the construction for applying magnetic force to the magnetic member 13 of the beam 12

As shown in FIG. 9B, the coil magnet 25 is formed by winding a wire at a plurality of times, and constant current is made to flow into the wound wire to apply predetermined magnetic force to the magnetic member 13. In this embodiment, the coil magnet 25 is disposed on the substrate 11 so as to be located below the magnetic member 13.

This coil magnet 25 is formed at the same time as the electrode 17E by adding the wiring pattern of the coil magnet 25 to a mask pattern in the vapor deposition process of forming the electrode 17E on the substrate 11, for example. As shown in FIG. 9B, an aperture 171 is provided at the center site of the electrode 17E, and the wound wire of the coil magnet 25 is formed at this site. The inner wire portion of the wound wire is led to the outside by multilayer interconnection.

A slit 172 is formed so as to extend from the center site of the electrode 17E to one end portion, and a leading wire is formed at the site of the slit 172 so as to extend from the wound wire of the coil magnet 25 to the external terminals T25*a* and T25*b*. As described above, the slit 172 is provided to the electrode 17E so as to prevent the electrode 17E from encircling the whole periphery of the wound wire of the coil magnet 25. Accordingly, when current is made to flow into the coil magnet 25 or current flow is stopped, eddy current can be avoided from occurring around the wound wire of the electrode 17E, so that the coil magnet 25 can be prevented from being affected by the eddy current.

According to the MEMS antenna 10E of the second embodiment, constant current is made to flow into the coil magnet 25 when the radio wave is received, thereby applying predetermined magnetic force from the coil magnet 25 to the magnetic member 13, and further the other operation is executed as in the case of the MEMS antenna 10 of the first embodiment, whereby the standard radio wave can be received.

Furthermore, according to the MEMS antenna 10E of the second embodiment, by changing the amount of current flowing in the coil magnet 25, the magnitude of the magnetic force applied from the coil magnet 25 to the magnetic member 13 of the beam 12 can be varied. When the magnetic force of the coil magnet 25 reduced, the displacement amount of the beam 12 to the incoming external magnetic field is reduced, so that the reception sensitivity of the MEMS antenna 10E is lowered.

Accordingly, when the signal level of the standard radio wave is excessively large and thus the voltage level of the AGC signal outputted from the detector 102 is lowered, the current flowing in the coil magnet 25 is lowered by the VI converter 108, and the reception sensitivity of the MEMS antenna 10E is lowered. Through the control operation as described above, the normal receiving operation can be executed on a standard radio wave having an excessively large signal level, and a reception signal having a proper signal level can be outputted.

Third Embodiment

Figure 10:
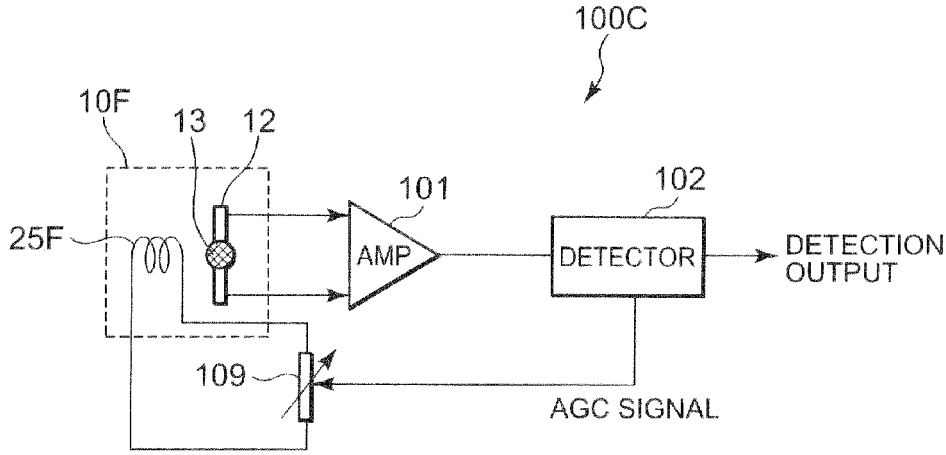
FIG. 10 is a diagram showing a radio wave receiver of a third embodiment according to the present invention.

FIG. 10 is a diagram showing the construction of the radio wave receiver of a third embodiment according to the present invention.

The radio wave receiver 100C of the third embodiment is different from the first and second embodiments only with respect to the MEMS antenna 10F and the construction of changing the reception sensitivity of the MEMS antenna 10F. The same constituent elements as the first and second embodiments are represented by the same reference numerals, and the description thereof is omitted.

The radio wave receiver 100C of this embodiment comprises an MEMS antenna 10F having a sensitivity adjusting coil 25F, a variable resistor 109 as a variable impedance section for adding variable resistance to current flowing in the sensitivity adjusting coil 25F, an amplifier 101 for amplifying a reception signal, and a detector 102 for detecting the reception signal into a time code and outputting an AGC signal for adjusting the reception sensitivity.

Figure 11A:
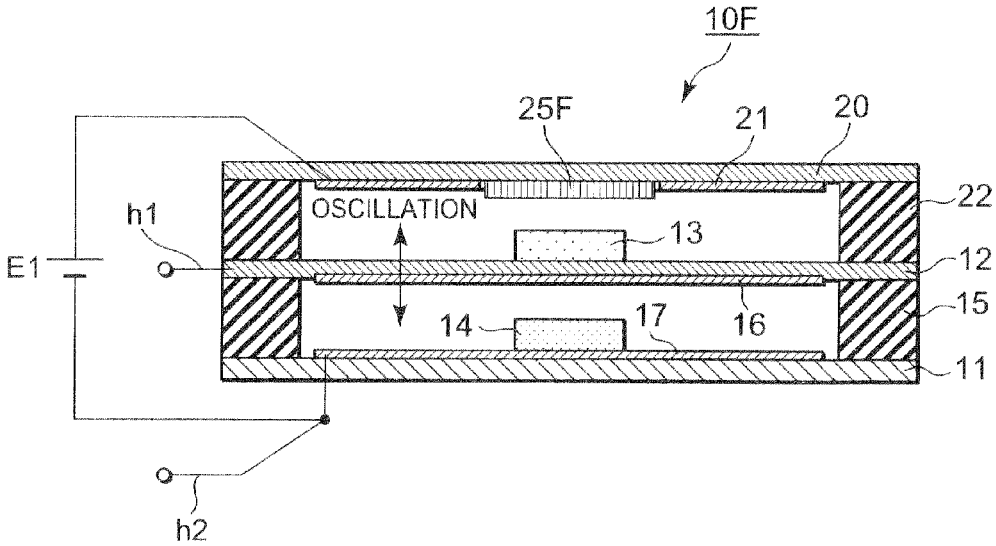
Figure 11B:
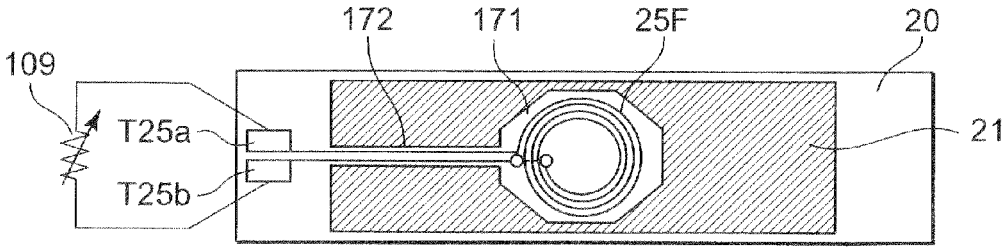

FIGS. 11A and 11B show the MEMS antenna 10F of the third embodiment, wherein FIG. 11A is a longitudinally sectional view and FIG. 11B is a plan view of the substrate surface including a sensitivity adjusting coil.

The MEMS antenna 10F of this embodiment is configured so that a sensitivity adjusting coil 25F shown in FIGS. 11A and 11B is formed on the cover plate 20 of the MEMS antenna 10A shown in FIG. 6. The wound wire and the leading wire of the sensitivity adjusting coil 25F can be formed by adding the wiring pattern of the sensitivity adjusting coil 25F to the mask pattern in the semiconductor fabrication process of forming the electrode 21 on the cover plate 20.

According to the MEMS antenna 10F of this embodiment, in a case where the resistance value of the variable resistor 109 is set to a small value, variation of the magnetic flux generated by the magnetic member 13 of the beam 12 penetrates through the sensitivity adjusting coil 25F when the beam 12 is oscillated by the magnetic field component of the standard radio wave. At this time, current flows in the sensitivity adjusting coil 25F and causes power consumption in the variable resistor 109. This power consumption acts to suppress the displacement of the beam 12. Therefore, the displacement degree of the beam 12 to the external magnetic field is lowered, and the reception sensitivity of the MEMS antenna 10F is lowered.

Furthermore, when the resistance value of the variable resistor 109 is set to a small value, current flows in the sensitivity adjusting coil 25F due to the magnetic field component of the standard radio wave, thereby a part of the standard radio wave is absorbed. Accordingly, the reception sensitivity of the MEMS antenna 10F is lowered.

On the other hand, when the resistance value of the variable resistor 109 is set to a large value, the current caused by the oscillation of the beam 12 and the current caused by the magnetic field component of the standard radio wave hardly flow in the sensitivity adjusting coil 25F. Therefore, the action of reducing the reception sensitivity as described above is not exercised. Accordingly, the sensitivity of the MEMS antenna 10F can be adjusted by changing the resistance value of the variable resistor 107.

Even in the radio wave receiver 100C of the third embodiment, when the signal level of the standard radio wave is excessively large, the AGC signal for reducing the resistance value of the variable resistor 109 is outputted from the detector 102, whereby the reception sensitivity of the MEMS antenna 10F is lowered. Through the above control, the normal receiving operation is executed on the standard radio wave having the excessively large reception level, whereby the reception signal having the proper signal level can be outputted.

In the third embodiment, a part of the electrode 21 is cut out and the sensitivity adjusting coil 25F is formed at this cut-out portion. However, various modifications may be made with respect to the method and the arrangement of forming the sensitivity adjusting coil 25F.

Figure 12:
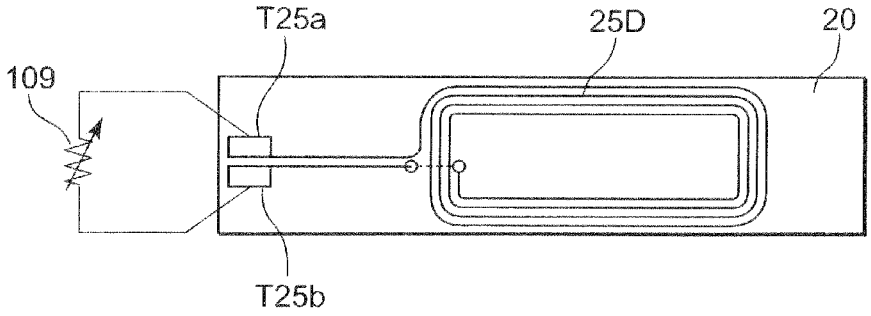
FIG. 12 is a plan view showing a first modification of the sensitivity adjusting coil.
Figure 13:
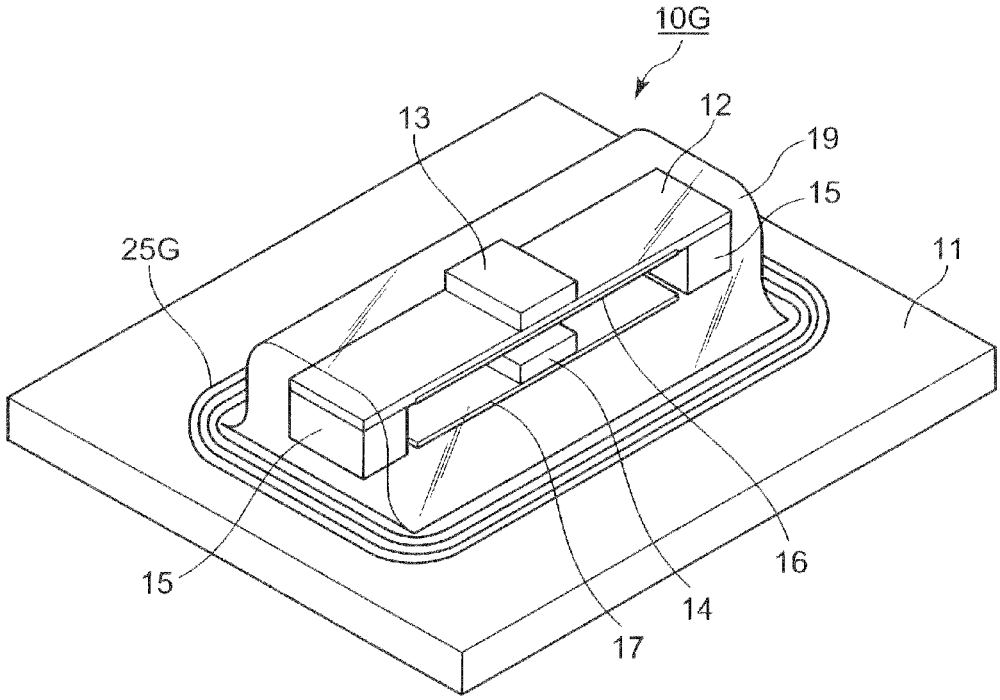
FIG. 13 is a perspective view showing a second modification of the sensitivity adjusting coil.

FIG. 12 is a plan view of a first modification of the sensitivity adjusting coil, and FIG. 13 is a perspective view showing a second modification of the sensitivity adjusting coil.

In the sensitivity adjusting coil 25D of the first modification, the electrode 21 is omitted from the cover plate 20 as shown in FIG. 12, so that the sensitivity adjusting coil 251) is formed in a larger range. The wound wire of the sensitivity adjusting coil 25D is formed to be larger in size, whereby the adjustment width of the sensitivity of the MEMS antenna 10F can be increased.

In the sensitivity adjusting coil 25G of the second modification, the wound wire is formed around the beam 12 on the substrate 11 so as to encircle the beam 12 as shown in FIG. 13. As not shown, a variable resistor is connected between the terminals of the sensitivity adjusting coil 25G.

Even when the sensitivity adjusting coil 25G is arranged as descried above, current is made to flow in the sensitivity adjusting coil 25G due to the oscillation of the beam 12 to thereby vary the sensitivity of the MEMS antenna 10G, and a part of the standard radio wave incoming from the external is absorbed by the sensitivity adjusting coil 25G, whereby the sensitivity of the MEMS antenna 10G can be varied.

Fourth Embodiment

Figure 14:
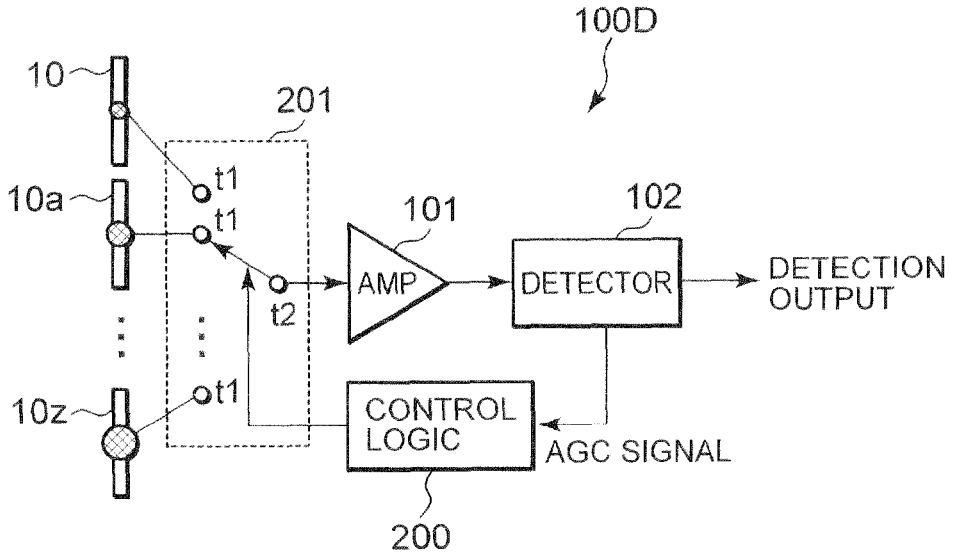
FIG. 14 is a diagram showing a radio wave receiver of a fourth embodiment according to the present invention.

FIG. 14 is a diagram showing the construction of the radio wave receiver of a fourth embodiment according to the present invention.

The radio wave receiver 100D of the fourth embodiment is provided with a plurality of MEMS antennas 10, 10*a* to 10*z* having different reception sensitivities, and any one of the MEMS antennas 10, 10*a* to 10*z* whose reception sensitivity is suitable for the signal level of an incoming standard radio wave is selected and used to perform radio wave reception.

The radio wave receiver 100D comprises the plurality of MEMS antennas 10, 10*a* to 10*z* being different in reception sensitivity to each other, a switch circuit 201 as a switch section which is selectively connected to any one of the MEMS antennas 10, 10*a* to 10*z*, an amplifier 101 for amplifying a reception signal taken through the switch circuit 201, a detector 102 for detecting the reception signal into a time code and outputting an AGC signal, a control logic 200 for controlling the switching operation of the switch circuit 201 in accordance with the magnitude of the AGC signal, etc.

In the plurality of MEMS antennas 10, 10*a* to 10*z*, for example, the magnetic member 13 formed on the beam 12 is designed so that the volume thereof is different among the plurality of MEMS antennas 10, 10*a* to 10*z*, whereby the degree of the displacement of the beam 12 to the external magnetic field, that is, the reception sensitivities of these antennas are different from one another. This plurality of MEMS antennas 10, 10*a* to 10*z* are formed on the same chip by the same fabrication process. In these MEMS antennas 10, 10*a* to 10*z*, the natural frequency of the each beam 12 is set to the same value among these antennas.

The switch circuit 201 is a switch formed by composing MOS transistors or bipolar transistors, for example, and it selectively connects one of the plurality of output terminals t1, t1 . . . t1 of the plurality of MEMS antennas 10,10*a* to 10*z* to the input terminal t2 of the amplifier 101.

The control logic 200 is designed to perform the following functions: First, the control logic 200 outputs a selection signal so that the connection of the switch circuit 201 is switched to an MEMS antenna having one-level lower reception sensitivity when the voltage level of the AGC signal is increased. Second the control logic 200 outputs a selection signal so that the connection of the switch circuit 201 is switched to an MEMS antenna having one-level higher reception sensitivity when the voltage level of the AGC signal is reduced.

Even in the electrical wave receiver 100D, the electrical wave reception is performed through any one of the MEMS antennas 10, 10*a* to 10*z* different in reception sensitivity by switching the connection of the switch circuit 201. Accordingly, when the signal level of the received standard radio wave is excessively large, the normal radio wave reception can be performed because the MEMS antenna having the low reception sensitivity is selected.

Fifth Embodiment

Figure 15:
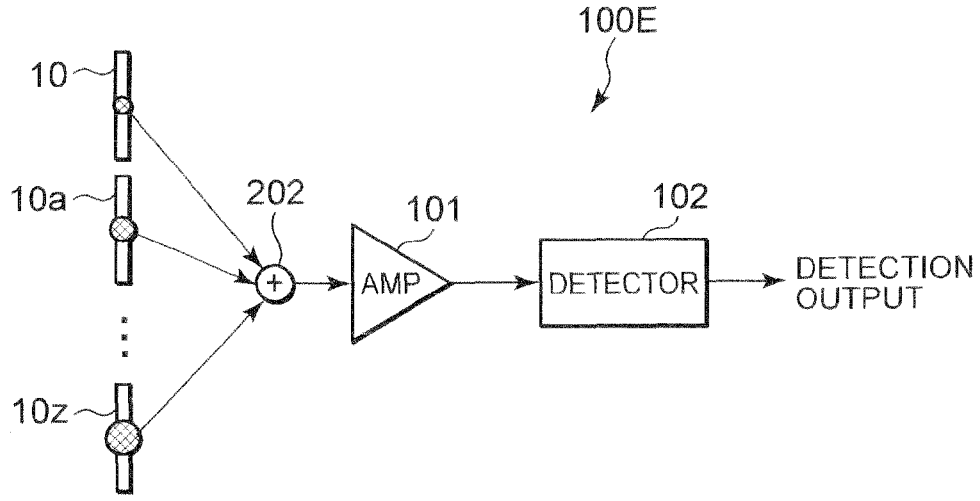
FIG. 15 is a diagram showing a radio wave receiver of a fifth embodiment according to the present invention.

FIG. 15 is a diagram showing the construction of the radio wave receiver of a fifth embodiment according to the present invention.

The radio wave receiver 100E of the fifth embodiment mixes a plurality of reception signals which are respectively outputted from the plurality of MEMS antennas 10, 10*a* to 10*z* having different reception sensitivities, and extracts a time code from a mixed reception signal.

The radio wave receiver 100E has the plurality of MEMS antennas 10, 10*a* to 10*z* having different reception sensitivities, a mixer 202 for mixing outputs of the MEMS antennas 10, 10*a* to 10*z*, an amplifier 101 for amplifying the reception signal taken through the mixer 202, an detector 102 for detecting the reception signal into a time code, etc.

The mixer 202 is a circuit for directly adding the signal levels of a plurality of input signals in an analog style and then outputting the added result, for example.

According to the radio wave receiver 100E, for example when a standard radio wave having a low signal level is received, proper oscillation is induced in the beam 12 of the MEMS antenna 10*z* having a high reception sensitivity, and a reception signal having a proper signal level is outputted. Furthermore, in the other MEMS antennas 10, 10*a*, etc. having different reception sensitivities, oscillation induced in the beam 12 is small, and a reception signal having a low signal level is outputted by the oscillation of the beam 12. These reception signals are mixed in the mixer 202, whereby a reception signal on which a modulation component based on the time code is greatly superposed can be sent to the amplifier 101.

On the other hand, when a standard radio wave having a very high signal level is received, proper oscillation is induced in the beam 12 of the MEMS antenna 10 having the low reception sensitivity, and a reception signal having a proper signal level is outputted. Furthermore, in the MEMS antenna 10*z* having the high reception sensitivity, the oscillation amplitude of the beam 12 reaches the maximum amplitude and thus is saturated by a standard radio wave having a very high signal level. Therefore, a reception signal which contains little modulation component based on the time code is outputted from the MEMS antenna 10*z*. Furthermore, reception signals having intermediate signal levels between the above reception signals are outputted from the MEMS antennas 10*a* . . . having intermediate reception sensitivities.

Consequently, these reception signals are mixed in the mixer 202, whereby the reception signal containing a fixed or more level of modulation components based on the time code can be outputted and sent to the amplifier 101.

Accordingly, in the radio wave receiver 100E of the fifth embodiment, the normal radio wave reception and the normal time code detection can be performed even when the signal level of the standard radio wave to be received is excessively large.

The present invention is not limited to the above embodiments, and various modifications may be made. For example, in the first and third embodiments, the variable resistor is adopted as the variable impedance section. However, the variable impedance section is not limited to the resistor insofar as it inputs an oscillation component signal of the beam 12 to vary the oscillation displacement amount.

In the first to fifth embodiments, the magnet 14 or the coil magnet 25 for applying magnetic force to the magnetic member 13 of the beam 12 is disposed below the beam 12. However, the arrangement of these elements may be variously changed. For example, they may be disposed above the beam 12 through spacers or disposed at the side of the beam 12. Furthermore, the magnet and the coil magnet may be afterwards attached to a chip having an MEMS antenna formed therein in a process different from the fabrication process of the MEMS antenna.

In the first to fifth embodiments, the MEMS antenna is formed on the silicon substrate. However, the substrate material is not limited to the silicon substrate, and the MEMS antenna may be integrated on a glass substrate, an organic material or the like. Furthermore, the beam 12 is designed so that the both ends thereof are supported and the center site thereof oscillates in the vertical direction as oscillating body. However, a cantilever type oscillating body which is supported at only one side thereof or a tuning fork type oscillating body may be adapted.

In the first to fifth embodiments, the magnetic member 13 is formed at a part of the beam 12. However, the magnetic member may be thinly formed over the overall beam 12, or the beam 12 itself may be formed of magnetic material. Furthermore, the magnet for applying magnetic force to the magnetic member may be omitted insofar as the device is configured so as to receive a radio wave signal having such magnitude that the beam can oscillate with only the magnetic member through receiving the magnetic field component of the radio wave signal.

In the first to fifth embodiments, the natural frequency of the beam 12 is made coincident with the frequency band of the reception radio wave. However, in such a case that the oscillation frequency of the beam is slightly deviated from the original natural frequency when the beam 12 actually resonates, the beam 12 may be formed so as to have a characteristic which is reflected to the deviation of the frequency.

In the fourth and fifth embodiments, the reception sensitivities of the plurality of MEMS antennas 10, 10*a* to 10*z* are made different from one another by designing the magnetic members 13 of the beams 12 thereof so as to be different in volume from one another. However, the magnitude of the magnetic force of the permanent magnet 14 may be made different among the MEMS antennas 10, 10*a* to 10*z*, for example. Alternatively, when the coil magnet 25 is applied in place of the permanent magnet 14, the value of current flowing in the coil magnet 25 may be made different among the MEMS antennas 10, 10*a* to 10*z*. Furthermore, it is unnecessary that all the MEMS antennas 10, 10*a* to 10*z* are set to the same type, and MEMS antennas having different structures may be mixed together and used.

What is claimed is:

1. An antenna device comprising:

an antenna unit having (i) an oscillating body that comprises a beam supported at one or more portions thereof and a magnetic member fixed on a displaceable portion of the beam, the oscillating body being capable of oscillating at a predetermined natural frequency and being displaceable by an external magnetic field, and (ii) a converter for converting motion of the oscillating body to an electrical signal, when a radio wave signal having a frequency band for inducing resonance of the oscillating body comes, the oscillating body resonating with a magnetic field component of the radio wave signal, the converter converting resonance of the oscillating body to the electrical signal, and an electrical signal corresponding to the radio wave signal being outputted;

a sensitivity varying section capable of varying a degree of displacement of the oscillating body occurring by the external magnetic field; and a sensitivity controller for adjusting the degree of the displacement by using the sensitivity varying section in accordance with the electrical signal outputted from the antenna unit.

2. The antenna device according to claim 1, wherein the sensitivity varying section comprises a variable impedance section for exerting variable impedance on an output of the converter.

3. The antenna device according to claim 2, further comprising a single chip substrate on which at least the antenna unit is formed.

4. The antenna device according to claim 1, further comprising a coil magnet for applying magnetic force to the oscillating body, wherein the sensitivity varying section comprises a variable current source capable of varying an amount of electric current flowing in the coil magnet.

5. The antenna device according to claim 4, further comprising a single chip substrate on which at least the antenna unit is formed.

6. The antenna device according to claim 1, wherein the sensitivity varying section comprises a coil disposed around the oscillating body, and a variable impedance section for exerting variable impedance on electric current flowing in the coil.

7. The antenna device according to claim 6, further comprising a single chip substrate on which at least the antenna unit is formed.

8. A reception device comprising:

the antenna device according to claim 1;

an amplifier for amplifying an electrical signal sent from the antenna device; and a demodulator for demodulating the electrical signal amplified by the amplifier.

9. A radio wave timepiece comprising:

the reception device according to claim 8, wherein the reception device receives a standard radio wave signal and demodulates the standard radio wave signal into a time code to correct time data.

10. An antenna device comprising:

a plurality of antenna units each of which has (i) an oscillating body that comprises a beam supported at one or more portions thereof and a magnetic member fixed on a displaceable Portion of the beam, the oscillating body being capable of oscillating at a predetermined natural frequency and being displaceable by an external magnetic field, and (ii) a converter for converting motion of the oscillating body to an electrical signal, when a radio wave signal having a frequency band for inducing resonance of the oscillating body comes, the oscillating body resonating with a magnetic field component of the radio wave signal, the converter converting resonance of the oscillating body to the electrical signal, and an electrical signal corresponding to the radio wave signal being outputted, and each of the antenna units being configured so that degree of displacement of the oscillating body by the external magnetic field is different with respect to each of the antenna units; and a mixer for mixing outputs of the plurality of antenna units and outputting a mixed signal.

11. The antenna device according to claim 10, further comprising a single chip substrate on which at least the antenna units are formed.

12. A reception device comprising:

the antenna device according to claim 10;

an amplifier for amplifying an electrical signal sent from the antenna device; and a demodulator for demodulating the electrical signal amplified by the amplifier.

13. A radio wave timepiece comprising:

the reception device according to claim 12, wherein the reception device receives a standard radio wave signal and demodulates the standard radio wave signal into a time code to correct time data.

14. An antenna device comprising:

a plurality of antenna units each of which has (i) an oscillating body that comprises a beam supported at one or more portions thereof and a magnetic member fixed on a displaceable portion of the beam, the oscillating body being capable of oscillating at a predetermined natural frequency and being displaceable by an external magnetic field, and (ii) a converter for converting motion of the oscillating body to an electrical signal, when a radio wave signal having a frequency band for inducing resonance of the oscillating body comes, the oscillating body resonating with a magnetic field component of the radio wave signal, the converter converting resonance of the oscillating body to the electrical signal, and an electrical signal corresponding to the radio wave signal being outputted, and each of the antenna units being configured so that degree of displacement of the oscillating body by the external magnetic field is different with respect to each of the antenna units; and a switch section for selectively sending an electrical signal from one of the plurality of antenna units to a subsequent stage.

15. The antenna device according to claim 1, further comprising a single chip substrate on which at least the antenna unit is formed.

16. The antenna device according to claim 14, further comprising a single chip substrate on which at least the antenna units are formed.

17. A reception device comprising:

the antenna device according to claim 14;

an amplifier for amplifying an electrical signal sent from the antenna device; and a demodulator for demodulating the electrical signal amplified by the amplifier.

18. A radio wave timepiece comprising:

the reception device according to claim 17, wherein the reception device receives a standard radio wave signal and demodulates the standard radio wave signal into a time code to correct time data.

* * * * *